US010221545B2

(12) United States Patent
Saro

(10) Patent No.: US 10,221,545 B2
(45) Date of Patent: Mar. 5, 2019

(54) SOAP DISPENSING SHOWER ASSEMBLY

(71) Applicant: Ralph Saro, Glen Rock, NJ (US)

(72) Inventor: Ralph Saro, Glen Rock, NJ (US)

( * ) Notice: Subject to any disclaimer, the term of this patent is extended or adjusted under 35 U.S.C. 154(b) by 0 days.

(21) Appl. No.: 15/616,534

(22) Filed: Jun. 7, 2017

(65) Prior Publication Data

US 2018/0355591 A1 Dec. 13, 2018

(51) Int. Cl.

| | |
|---|---|
| ***E03C 1/046*** | (2006.01) |
| ***B05B 7/24*** | (2006.01) |
| ***A47K 7/02*** | (2006.01) |
| ***E03C 1/04*** | (2006.01) |
| ***B05B 1/18*** | (2006.01) |

(52) U.S. Cl.

CPC ..... *E03C 1/046* (2013.01); *A47K 7/028* (2013.01); *B05B 1/18* (2013.01); *B05B 7/2462* (2013.01); *E03C 1/0409* (2013.01)

(58) Field of Classification Search

CPC ..... E03C 1/046; E03C 1/0465; E03C 1/0409; B05B 7/2462; B05B 1/18

See application file for complete search history.

(56) References Cited

U.S. PATENT DOCUMENTS

| | | | | |
|---|---|---|---|---|
| 3,083,915 | A | 4/1963 | Grauel | |
| 3,231,200 | A | 1/1966 | Heald | |
| 3,944,140 | A * | 3/1976 | Caton | B05B 3/04 15/24 |
| 4,933,080 | A * | 6/1990 | Rundzaitis | B01D 35/043 210/232 |
| 4,998,836 | A * | 3/1991 | Scripnick | B05B 7/30 137/878 |
| D326,896 | S | 6/1992 | McNeely | |
| 5,579,656 | A * | 12/1996 | Shin | D06F 39/02 137/268 |
| 5,716,005 | A | 2/1998 | McMahan | |
| 5,957,379 | A * | 9/1999 | McMorrow | B05B 7/2445 239/10 |
| 6,036,110 | A * | 3/2000 | Kanatzar | E03C 1/046 239/317 |
| 6,419,166 | B1 * | 7/2002 | Brzezinski | A46B 11/066 222/395 |
| 6,687,924 | B2 | 1/2004 | Wright et al. | |
| 8,393,350 | B2 * | 3/2013 | Chiriac | E03C 1/046 137/268 |
| 8,702,018 | B1 * | 4/2014 | Rivera | E03C 1/0408 137/888 |
| 9,157,218 | B2 * | 10/2015 | Somerfield | E03C 1/046 |
| 2008/0169359 | A1 | 7/2008 | Carrubba et al. | |

* cited by examiner

*Primary Examiner* — Alexander M Valvis

(57) ABSTRACT

A soap dispensing shower assembly for selectively spraying a mixture of soap and a fluid includes a dispensing unit has soap positioned therein. The dispensing unit is fluidly coupled to a fluid supply thereby facilitating a fluid to be mixed with the soap. A spray unit is fluidly coupled to the housing. The spray unit selectively sprays the mixture of the soap and the fluid for bathing.

12 Claims, 3 Drawing Sheets

SOAP DISPENSING SHOWER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shower devices and more particularly pertains to a new shower device for selectively spraying a mixture of soap and a fluid.

BRIEF SUMMARY OF THE INVENTION

An embodiment of the disclosure meets the needs presented above by generally comprising a dispensing unit has soap positioned therein. The dispensing unit is fluidly coupled to a fluid supply thereby facilitating a fluid to be mixed with the soap. A spray unit is fluidly coupled to the housing. The spray unit selectively sprays the mixture of the soap and the fluid for bathing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
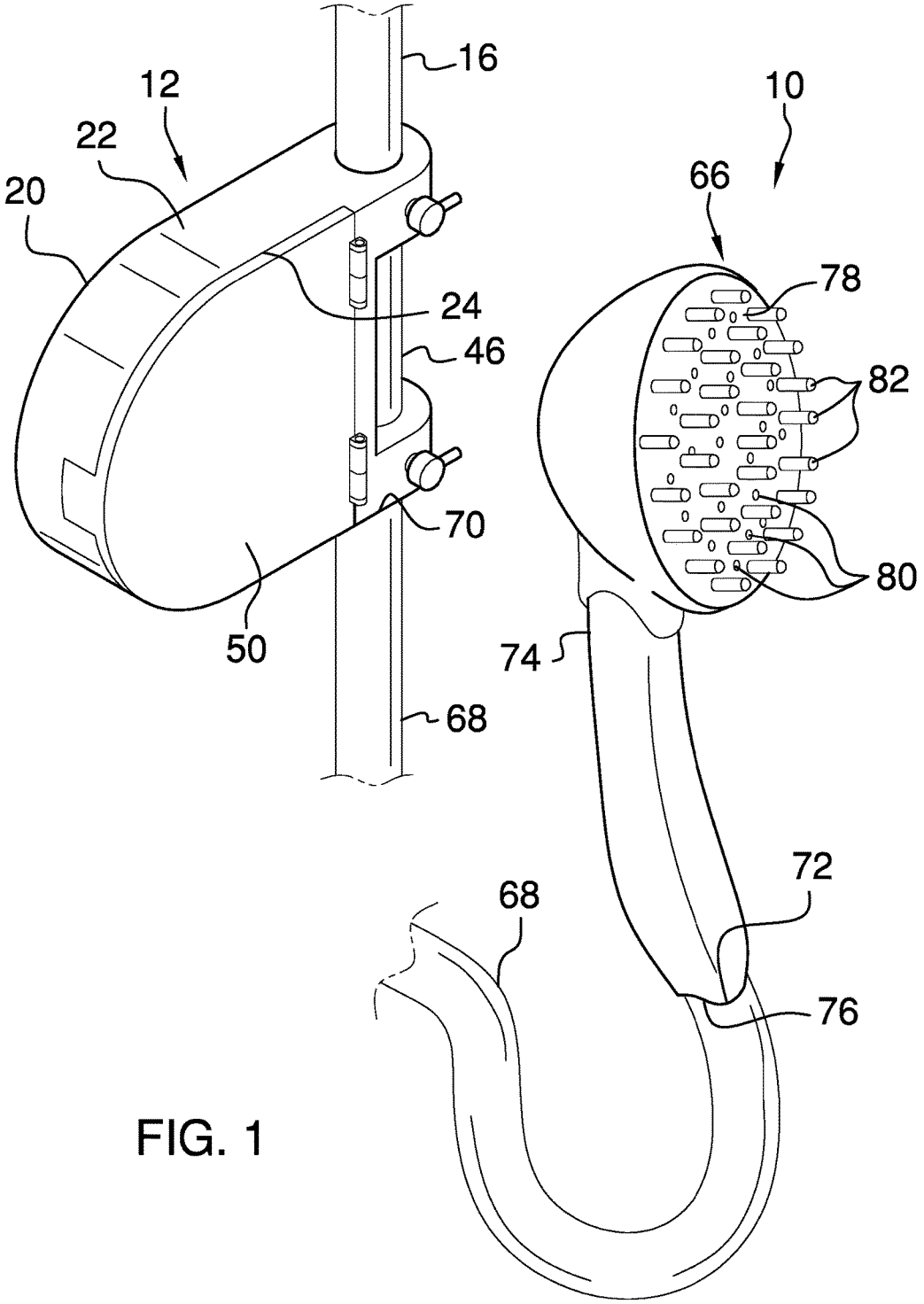
FIG. 1 is a perspective view of a soap dispensing shower assembly according to an embodiment of the disclosure.
Figure 2:
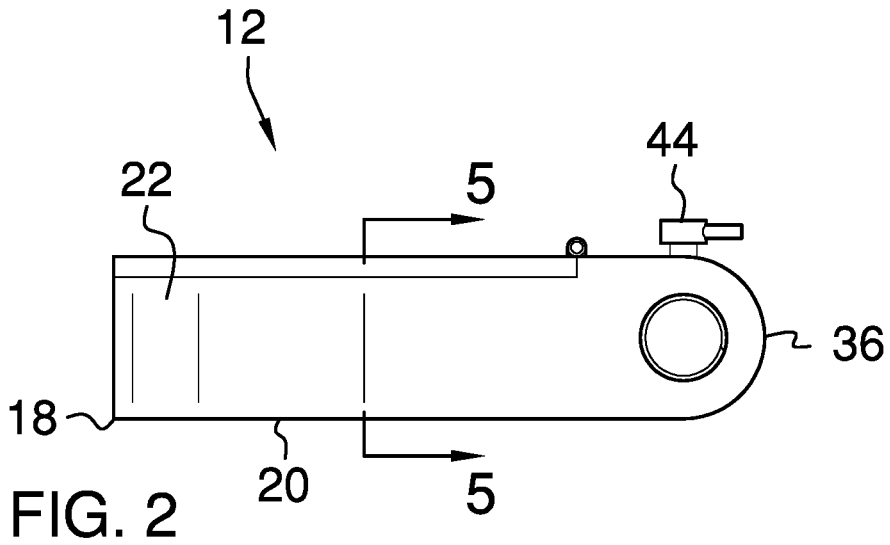
FIG. 2 is a top view of a dispensing unit of an embodiment of the disclosure.
Figure 3:
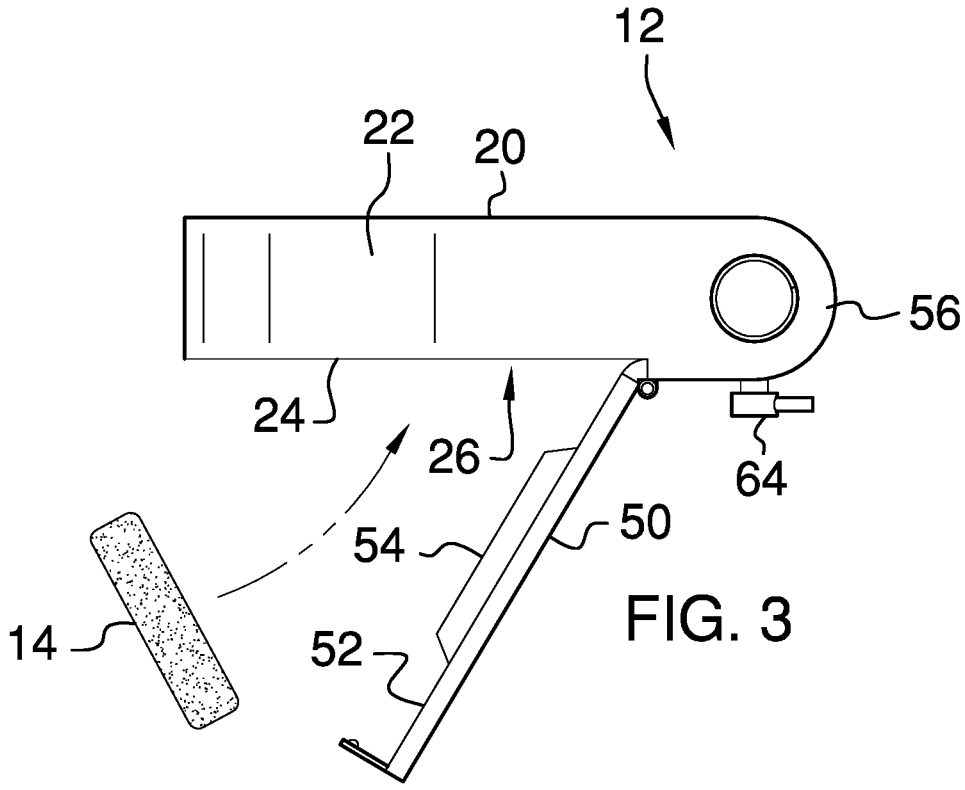
FIG. 3 is a bottom view of a dispensing unit of an embodiment of the disclosure.
Figure 4:
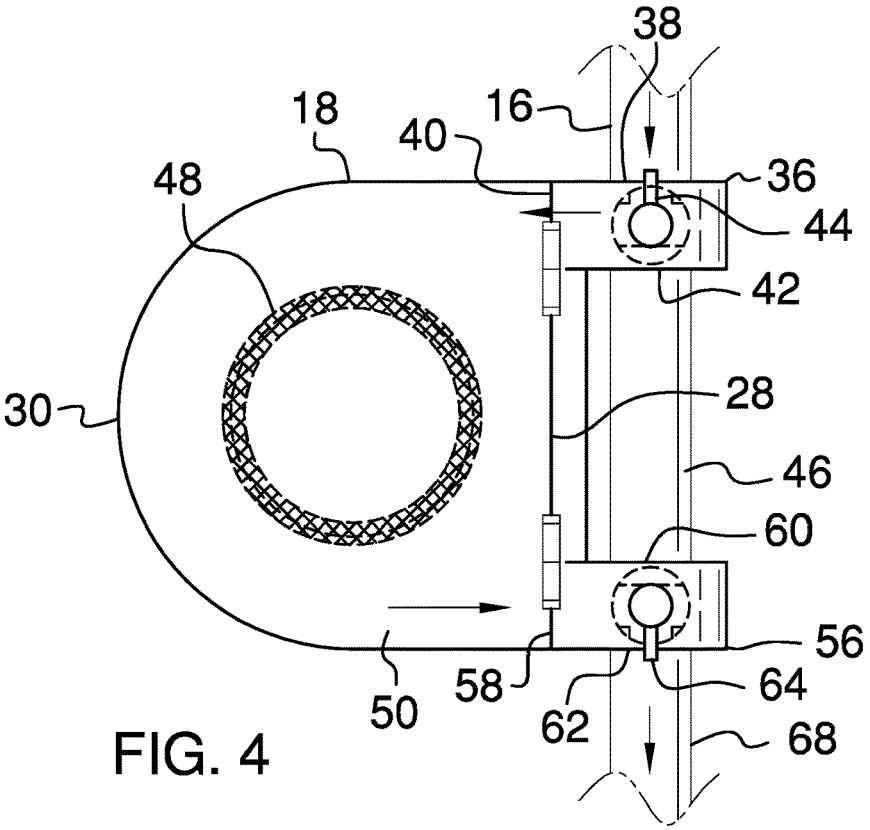
FIG. 4 is a front phantom view of a dispensing unit of an embodiment of the disclosure.
Figure 5:
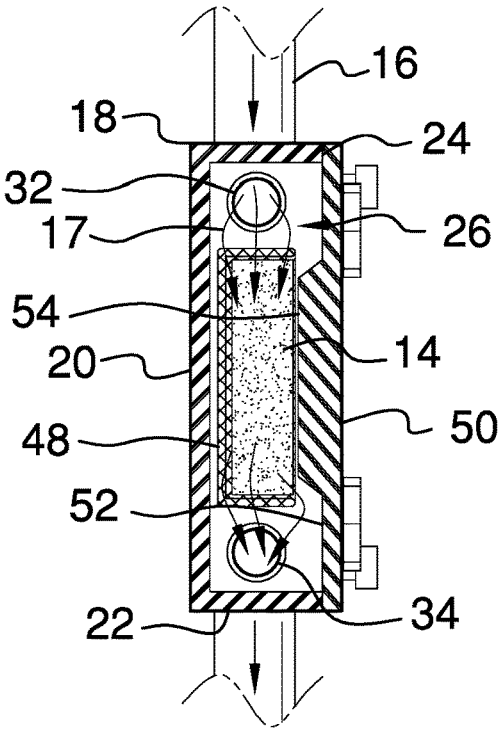
FIG. 5 is a cross sectional view taken along line 5-5 of FIG. 2 of an embodiment of the disclosure.

With reference now to the drawings, and in particular to FIGS. 1 through 5 thereof, a new shower device embodying the principles and concepts of an embodiment of the disclosure and generally designated by the reference numeral 10 will be described.

As best illustrated in FIGS. 1 through 5, the soap dispensing shower assembly 10 generally comprises a dispensing unit 12 that has soap 14 selectively positioned therein. The dispensing unit 12 is fluidly coupled to a fluid supply 16 thereby facilitating a fluid 17 to be mixed with the soap 14. The fluid supply 16 may be a water line in a bathtub, shower any other bathing fixture and the fluid 17 may be water. The soap 14 may be bar soap, liquid soap and any other convention bathing soap.

The dispensing unit 12 comprises a housing 18 that has a basal wall 20 and a perimeter wall 22 extending away therefrom. The perimeter wall 22 has a distal edge 24 with respect to the basal wall 20 to define an opening 26 into an interior of the housing 18. The perimeter wall 22 has a first side 28 and a second side 30 and the second side 30 is concavely arcuate with respect to the first side 28. The first side 28 has a first aperture 32 extending into the interior of the housing 18. The first side 28 has a second aperture 34 extending into the interior of the housing 18. Moreover, the second aperture 34 is spaced from the first aperture 32.

A first valve 36 is provided and the first valve 36 is coupled to the first side 28 of the housing 18. The first valve 36 has an input 38, a first output 40 and a second output 42. The first output 40 is aligned with the first aperture 32 and the input 38 is fluidly coupled to the fluid supply 16. The first valve 36 is selectively positioned in a first open position to direct the fluid 17 from the input 38 to the first output 40. The first valve 36 is selectively positioned in a second open position to direct the fluid 17 from the input 38 to the second output 42. Additionally, the first valve 36 is selectively positioned in a closed position to inhibit the fluid 17 from entering the input 38. The first valve 36 may be a three position fluid valve or the like.

A first lever 44 is coupled to the first valve 36 and the first lever 44 is selectively manipulated. The first valve 36 selectively urges the first valve 36 between the first open position, the second open position and the closed position. A conduit 46 is fluidly coupled to the second output 42 of the first valve 36 to receive the fluid 17 when the first valve 36 is positioned in the second open position.

A basket 48 is coupled to an inside surface of the basal wall 20 such that the basket 48 is positioned within the housing 18. The soap 14 is positioned in the basket 48 such that the soap 14 is retained in the basket 48. Additionally, the basket 48 is positioned between the first 32 and second 34 apertures to position the soap 14 within a flow of the fluid 17. The basket 48 is comprised of a mesh material to facilitate the fluid 17 to mix with the soap 14 when the first valve 36 is positioned in the first open position.

A door 50 is hingedly coupled to the distal edge 24 of the housing 18 and the door 50 selectively opens and closes the housing 18. The door 50 has a first surface 52 and the first surface 52 has a prominence 54 extending away therefrom. The prominence 54 is aligned with the basket 48 when the door 50 is closed. The prominence 54 abuts the soap 14 to retain the soap 14 in the basket 48 when the door 50 is closed.

A second valve 56 is coupled to the first side 28 of the housing 18. The second valve 56 has a first input 58, a second input 60 and an output 62. The first input 58 of the second valve 56 is fluidly coupled to the conduit 46 to receive the fluid from the conduit 46 when the first valve 36 is positioned in the second position. The second input 60 is aligned with the second aperture 34 to receive the mixture of the soap 14 and the fluid 17 from the housing 18 when the first valve 36 is positioned in the first position.

The second valve 56 is selectively positioned between a primary open position, a secondary open position and a closed position. The second valve 56 directs the mixture of the soap 14 and the fluid 17 outwardly through the output 62 of the second valve 56 when the second valve 56 is positioned in the primary open position and the first valve 36 is positioned in the first open position. The second valve 56 directs the fluid 17 from the conduit 46 outwardly through the output 62 of the second valve 56 when the second valve 56 is positioned in the secondary open position and the first valve 36 is positioned in the second open position. Moreover, the second valve 56 inhibits a flow of the fluid 17 through the output 62 of the second valve 56 when the second valve 56 is positioned in the closed position. The second valve 56 may be a three position fluid valve or the like. A second lever 64 is movably coupled to the second valve 56 and the second lever 64 is selectively manipulated. The second lever 64 selectively urges the second valve 56 between the primary open position, the secondary open position and closed position.

A spray unit 66 is provided and the spray unit 66 is selectively manipulated for bathing. The spray unit 66 is fluidly coupled to the housing 18. Thus, the spray unit 66 selectively sprays the mixture of the soap 14 and the fluid 17 for bathing. The spray unit 66 comprises a hose 68 that has a first end 70 and a second end 72. The first end 70 is fluidly coupled to the output 62 of the second valve 56.

The hose 68 receives the mixture of the soap 14 and the fluid 17 when the first valve 36 is positioned in the first open position and the second valve 56 is positioned in the primary open position. The hose 68 receives the fluid 17 when the first valve 36 is positioned in the second open position and the second valve 56 is positioned in the secondary open position. A shower head 74 is provided that has a primary end 76 and a secondary end 78. The primary end 76 is open and the shower head 74 is substantially hollow. The secondary end 78 has a plurality of openings 80 extending into an interior of the shower head 74.

The primary end 76 is fluidly coupled to the second end 72 of the hose 68. Each of the openings 80 selectively sprays the mixture of the soap 14 and the fluid 17 outwardly therefrom for washing. Additionally, each of the openings 80 selectively sprays the fluid 17 outwardly therefrom for rinsing. A plurality of bristles 82 is provided and each of the bristles 82 is coupled to and extends away from the secondary end 78 of the shower head 74 for scrubbing. The bristles 82 are spaced apart from each other and are distributed on the secondary end 78. Moreover, each of the bristles 82 is offset with respect to the openings 80.

In use, the soap 14 is positioned in the basket 48 and the door 50 is closed. The first valve 36 is selectively positioned in the first open position and the second valve 56 is selectively positioned in the primary open position. Thus, the mixture of soap 14 and fluid 17 is sprayed outwardly through the shower head 74 for bathing. The first valve 36 is selectively positioned in the second open position and the second valve 56 is selectively positioned in the secondary open position. Thus, the fluid 17 is sprayed outwardly through the shower head 74 for rinsing. Each of the first valve 36 and the second valve 56 is selectively positioned in the closed position to inhibit the fluid 17 from flowing into the housing 18 and outwardly from the shower head 74. The dispensing unit 12 facilitates a physically disabled person to bathe without having to manipulate a bar of soap and a washcloth.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A soap dispensing shower assembly being configured to selectively release soap for bathing, said assembly comprising:

a dispensing unit having soap positioned therein, said dispensing unit being configured to be fluidly coupled to a fluid supply thereby facilitating a fluid to be mixed with said soap forming a mixture, said dispensing unit comprising a housing, said housing having a basal wall and a perimeter wall extending away therefrom, said perimeter wall having a distal edge with respect to said basal wall to define an opening into an interior of said housing, said perimeter wall having a first side and a second side, said second side being concavely arcuate with respect to said first side, said first side having a first aperture extending into said interior of said housing, said first side having a second aperture extending into said interior of said housing, said second aperture being spaced from said first aperture;

a first valve being coupled to said first side of said housing, said first valve having an input, a first output and a second output, said first output being aligned with said first aperture, said input being configured to be fluidly coupled to the fluid supply, said first valve being selectively positioned in a first open position wherein said first valve is configured to direct the fluid from said input to said first output, said first valve being selectively positioned in a second open position wherein said first valve is configured to direct the fluid from said input to said second output, said first valve being selectively positioned in a closed position wherein said first valve is configured to inhibit the fluid from entering said input;

a basket being coupled to an inside surface of said basal wall such that said basket is positioned within said housing, said soap being positioned in said basket such that said soap is retained in said basket, said basket being positioned between said first and second apertures wherein said basket is configured to position said soap within a flow of the fluid, said basket being comprised of a mesh material wherein said basket is configured to facilitate the fluid to mix with said soap when said first valve is positioned in said first open position;

a door being hingedly coupled to said distal edge of said housing such that said door selectively opens and closes said housing, said door having a first surface, said first surface having a prominence extending away therefrom, said prominence being aligned with said basket when said door is closed such that said prominence abuts said soap to retain said soap in said basket; and a spray unit being configured to be manipulated, said spray unit being fluidly coupled to said housing wherein said spray unit is configured to selectively spray the mixture of said soap and the fluid for bathing.

2. The assembly according to claim 1, further comprising a first lever being movably coupled to said first valve wherein said first lever is configured to be manipulated, said first lever selectively urging said first valve between said first open position, said second open position and said closed position.

3. The assembly according to claim 1, further comprising a conduit being fluidly coupled to said second output of said first valve wherein said conduit is configured to receive the fluid when said first valve is positioned in said second open position.

4. The assembly according to claim 1, further comprising:

a conduit; and a second valve being coupled to said first side of said housing, said second valve having a first input, a second input and an output, said first input of said second valve being fluidly coupled to said conduit wherein said first input of said second valve is configured to receive the fluid from said conduit when said first valve is positioned in said second position.

5. The assembly according to claim 4, wherein said second input is aligned with said second aperture wherein said second input is configured to receive the mixture of said soap and the fluid from said housing when said first valve is positioned in said first position.

6. The assembly according to claim 5, wherein said second valve is selectively positioned between a primary open position, a secondary open position and a closed position, said second valve being configured to direct the mixture of said soap and the fluid outwardly through said output of said second valve when said second valve is positioned in said primary open position and said first valve is positioned in said first open position, said second valve is configured to direct the fluid from said conduit outwardly through said output of said second valve when said second valve is positioned in said secondary open position and said first valve is positioned in said second open position, said second valve being configured to inhibit a flow of the fluid through said output of said second valve when said second valve is positioned in said closed position.

7. The assembly according to claim 6, further comprising a second lever being movably coupled to said second valve wherein said second lever is configured to be manipulated, said second lever selectively urging said second valve between said primary open position, said secondary open position and closed position.

8. The assembly according to claim 6, wherein said spray unit comprises a hose having a first end and a second end, said first end being fluidly coupled to said output of said second valve, said hose being configured to receive the mixture of said soap and the fluid when said first valve is positioned in said first open position and said second valve is positioned in said primary open position, said hose being configured to receive the fluid when said first valve is positioned in said second open position and said second valve is positioned in said secondary open position.

9. The assembly according to claim 8, further comprising a shower head having a primary end and a secondary end, said primary end being open, said shower head being substantially hollow, said secondary end having a plurality of openings extending into an interior of said shower head.

10. The assembly according to claim 9, wherein said primary end is fluidly coupled to said second end of said hose, each of said openings being configured to spray the mixture of said soap and the fluid outwardly therefrom for washing, each of said openings being configured to spray the fluid outwardly therefrom for rinsing.

11. The assembly according to claim 9, further comprising a plurality of bristles, each of said bristles being coupled to and extending away from said secondary end of said shower head for scrubbing, said bristles being spaced apart from each other and being distributed on said secondary end, each of said bristles being offset with respect to said plurality of openings.

12. A soap dispensing shower assembly being configured to selectively release soap for bathing, said assembly comprising:

a dispensing unit having soap positioned therein, said dispensing unit being configured to be fluidly coupled to a fluid supply thereby facilitating a fluid to be mixed with said soap, said dispensing unit comprising:

a housing having a basal wall and a perimeter wall extending away therefrom, said perimeter wall having a distal edge with respect to said basal wall to define an opening into an interior of said housing, said perimeter wall having a first side and a second side, said second side being concavely arcuate with respect to said first side, said first side having a first aperture extending into said interior of said housing, said first side having a second aperture extending into said interior of said housing, said second aperture being spaced from said first aperture, a first valve being coupled to said first side of said housing, said first valve having an input, a first output and a second output, said first output being aligned with said first aperture, said input being configured to be fluidly coupled to the fluid supply, said first valve being selectively positioned in a first open position wherein said first valve is configured to direct the fluid from said input to said first output, said first valve being selectively positioned in a second open position wherein said first valve is configured to direct the fluid from said input to said second output, said first valve being selectively positioned in a closed position wherein said first valve is configured to inhibit the fluid from entering said input, a first lever being coupled to said first valve wherein said first lever is configured to be manipulated, said first lever selectively urging said first valve between said first open position, said second open position and said closed position, a conduit being fluidly coupled to said second output of said first valve wherein said conduit is configured to receive the fluid when said first valve is positioned in said second open position, a basket being coupled to an inside surface of said basal wall such that said basket is positioned within said housing, said soap being positioned in said basket such that said soap is retained in said basket, being positioned between said first and second apertures wherein said basket is configured to position said soap within a flow of the fluid, said basket being comprised of a mesh material wherein said basket is configured to facilitate the fluid to mix with said soap when said first valve is positioned in said first open position, a door being hingedly coupled to said distal edge of said housing such that said door selectively opens and closes said housing, said door having a first surface, said first surface having a prominence extending away therefrom, said prominence being aligned with said basket when said door is closed such that said prominence abuts said soap to retain said soap in said basket, a second valve being coupled to said first side of said housing, said second valve having a first input, a second input and an output, said first input of said second valve being fluidly coupled to said conduit wherein said first input of said second valve is configured to receive the fluid from said conduit when said first valve is positioned in said second position, said second input being aligned with said second aperture wherein said second input is configured to receive the mixture of said soap and the fluid from said housing when said first valve is positioned in said first position, said second valve being selectively positioned between a primary open position, a secondary open position and a closed position, said second valve being configured to direct the mixture of said soap and the fluid outwardly through said output of said second valve when said second valve is positioned in said primary open position and said first valve is positioned in said first open position, said second valve being configured to direct the fluid from said conduit outwardly through said output of said second valve when said second valve is positioned in said secondary open position and said first valve is positioned in said second open position, said second valve being configured to inhibit a flow of the fluid through said output of said second valve when said second valve is positioned in said closed position, and a second lever being movably coupled to said second valve wherein said second lever is configured to be manipulated, said second lever selectively urging said second valve between said primary open position, said secondary open position and closed position; and a spray unit being configured to be manipulated, said spray unit being fluidly coupled to said housing wherein said spray unit is configured to selectively spray the mixture of said soap and the fluid for bathing, said spray unit comprising:

a hose having a first end and a second end, said first end being fluidly coupled to said output of said second valve, said hose being configured to receive the mixture of said soap and the fluid when said first valve is positioned in said first open position and said second valve is positioned in said primary open position, said hose being configured to receive the fluid when said first valve is positioned in said second open position and said second valve is positioned in said secondary open position, a shower head having a primary end and a secondary end, said primary end being open, said shower head being substantially hollow, said secondary end having a plurality of openings extending into an interior of said shower head, said primary end being fluidly coupled to said second end of said hose, each of said openings being configured to spray the mixture of said soap and the fluid outwardly therefrom for washing, each of said openings being configured to spray the fluid outwardly therefrom for rinsing, and a plurality of bristles, each of said bristles being coupled to and extending away from said secondary end of said shower head for scrubbing, said bristles being spaced apart from each other and being distributed on said secondary end, each of said bristles being offset with respect to said plurality of openings.

* * * * *